US007832245B2

(12) United States Patent
Schreiber

(10) Patent No.: US 7,832,245 B2
(45) Date of Patent: Nov. 16, 2010

(54) METHOD AND APPARATUS FOR HOT FORMING OF SHEET METAL IN TITANIUM-BASE ALLOYS

(75) Inventor: Karl Schreiber, AM Mellensee (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 335 days.

(21) Appl. No.: 12/076,462

(22) Filed: Mar. 19, 2008

(65) Prior Publication Data

US 2008/0229797 A1 Sep. 25, 2008

(30) Foreign Application Priority Data

Mar. 23, 2007 (DE) ..... 10 2007 014 948

(51) Int. Cl.
*B21D 31/00* (2006.01)
*B21D 26/02* (2006.01)
*B21B 9/00* (2006.01)

(52) U.S. Cl. ..... 72/60; 72/38; 72/342.7; 72/342.8; 72/342.92; 72/709; 29/421.1

(58) Field of Classification Search ..... 72/56, 72/57, 60, 63, 342.7, 342.8, 342.92, 709; 29/421.1
See application file for complete search history.

(56) References Cited

U.S. PATENT DOCUMENTS

| | | | | |
|---|---|---|---|---|
| 3,934,441 | A | 1/1976 | Hamilton | |
| 4,117,970 | A | 10/1978 | Hamilton | |
| 4,352,280 | A * | 10/1982 | Ghosh | 72/60 |
| 4,354,369 | A | 10/1982 | Hamilton | |
| 4,951,491 | A * | 8/1990 | Lorenz | 72/60 |
| 4,984,348 | A | 1/1991 | Cadwell | |
| 5,277,045 | A * | 1/1994 | Mahoney et al. | 72/709 |
| 5,419,170 | A * | 5/1995 | Sanders et al. | 29/421.1 |
| 5,823,032 | A * | 10/1998 | Fischer | 72/60 |
| 6,116,070 | A * | 9/2000 | Oshida et al. | 72/60 |
| 6,182,486 | B1 * | 2/2001 | Chuang | 72/709 |
| 6,202,276 | B1 | 3/2001 | Chuang | |
| 6,253,588 | B1 * | 7/2001 | Rashid et al. | 72/57 |
| 6,615,631 | B2 * | 9/2003 | Kleber et al. | 72/60 |
| 6,843,088 | B1 * | 1/2005 | Kruger et al. | 72/57 |
| 7,159,437 | B2 * | 1/2007 | Schroth et al. | 72/342.8 |
| 7,318,333 | B2 * | 1/2008 | Allor et al. | 29/421.1 |
| 7,614,270 | B2 * | 11/2009 | Luckey et al. | 72/342.7 |
| 7,669,450 | B2 * | 3/2010 | Friedman et al. | 72/60 |

FOREIGN PATENT DOCUMENTS

| | | |
|---|---|---|
| DE | 31 31 931 C2 | 2/1983 |
| DE | 693 18 022 T2 | 9/1998 |
| DE | 698 01 057 T2 | 11/2001 |
| EP | 0 648 555 A1 | 4/1995 |
| EP | 1 007 608 B1 | 7/2001 |

* cited by examiner

*Primary Examiner*—David B Jones
(74) *Attorney, Agent, or Firm*—Timothy J. Klima; Shuttleworth & Ingersoll, PLC

(57) ABSTRACT

A titanium sheet to be formed is heated in a sealingly closed tool by the radiation heat from the heating elements integrated into the tool to a forming temperature not exceeding 600° C., and is deformed towards a cold tool contour by the action of a non-oxidizing gaseous pressure medium introduced into the tool and heated to the hot-forming temperature, as well as by underpressure generated on the side of the workpiece facing away from the pressure medium.

19 Claims, 1 Drawing Sheet

METHOD AND APPARATUS FOR HOT FORMING OF SHEET METAL IN TITANIUM-BASE ALLOYS

Figure 1:
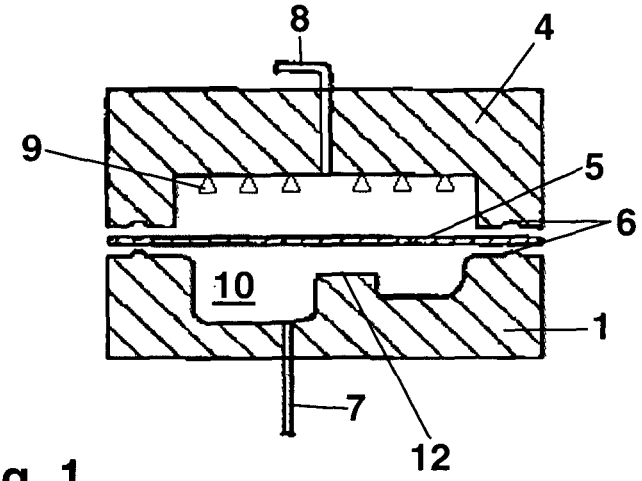

This application claims priority to German Patent Application DE102007014948.6 filed Mar. 23, 2007, the entirety of which is incorporated by reference herein.

This invention relates to a method for hot forming of sheet metal in titanium-base alloys and to a forming apparatus for the performance of said method.

Titanium alloys are generally rated as difficult to form and often have forming properties which are less predictable than those of other alloys, such as steel or aluminium alloys. In particular the amount of spring-back, which occurs primarily during cold forming, rarely also during hot forming, of thin titanium sheet metal is difficult to predict. Therefore, many components in titanium alloys are produced by forming at elevated temperatures or, in the case of components with straight sections and sufficiently large bending radius of the tool, also by cold forming, as applicable in several forming steps or with a subsequent hot-forming operation. Overforming has also been proposed to compensate for the disadvantages related to spring-back. Further problems encountered with forming of titanium are the hazard of crack formation, tool wear and material embrittlement, especially during hot forming, as well as the tendency to irregularity due to the anisotropy of thin sheet.

Cold forming of titanium and titanium alloys is feasible with very simple geometry of the workpiece, large bending radii of the tool and heating of the forming tool in a multistage process at room temperature or at elevated temperatures between 215° and 315° C.

Better formability of titanium alloys at elevated temperature is accompanied by a reduction of spring-back and yield strength, permitting forming in only one forming step. Besides the considerable apparatus and energy requirements for tool heating, very low forming rates in connection with long holding times at high temperatures are necessary, as a result of which hot forming is a highly costly process.

Some titanium alloys have superplastic properties when hot formed at very high temperature, however, a protective gas atmosphere or coating of the workpiece is required at temperatures above 540° C. as the material is susceptible to embrittlement and scaling under conditions of oxygen enrichment. Superplastic properties of some titanium alloys are found in the temperature range between 870° and 950° C. and at very low forming rates. The low yield stress at these temperatures and the low forming rates require only small forming forces. In order to avoid surface oxidation, the forming process, which can be accomplished in a single step, is performed in a protective gas atmosphere or in vacuum. Considering the high tool temperatures and the very high oxygen affinity of titanium at such temperatures in connection with the increased hazard of oxidation and embrittlement resulting therefrom, the advantages of high forming degree and avoided spring-back are dearly bought with high cost.

The present invention, in a broad aspect, provides a method for hot forming of titanium sheet in a single forming step which ensures the provision of high-quality titanium sheet products while reducing tooling and energy costs as well as tooling wear.

In the present invention, the titanium sheet to be formed is heated in a sealingly closed tool to a hot-forming temperature of max. 600° C. by radiation heat from heating elements integrated into the tool and is formed by the action of a gaseous pressure medium heated to the hot-forming temperature and fed into the tool and a vacuum produced on the side of the workpiece facing away from the pressure medium.

The inventive forming apparatus for the performance of the method comprises a forming tool featuring the forming tool contour and a hollow tool body between which the titanium sheet to be formed is sealingly held. Integrated into the hollow body of the tool are radiant heating elements for heating the titanium sheet to be formed and at least one inlet port connected to a pressure medium source for supplying a heated gaseous pressure medium acting with a specific forming force upon the heated titanium sheet. The forming tool is provided with at least one evacuation port connected to a vacuum pump to produce a vacuum on that side of the titanium sheet to be formed which is facing away from the pressure medium.

The method proposed and the respective forming apparatus enable titanium sheet to be formed with low apparatus and energy investment in a single operation without spring-back and without material damage.

Figure 2:
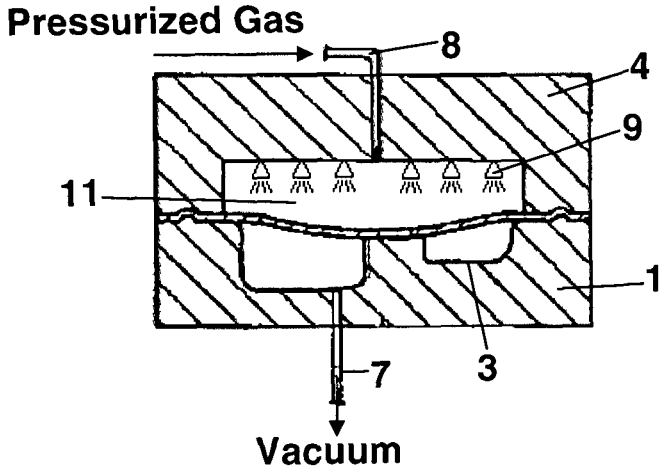
Figure 3:
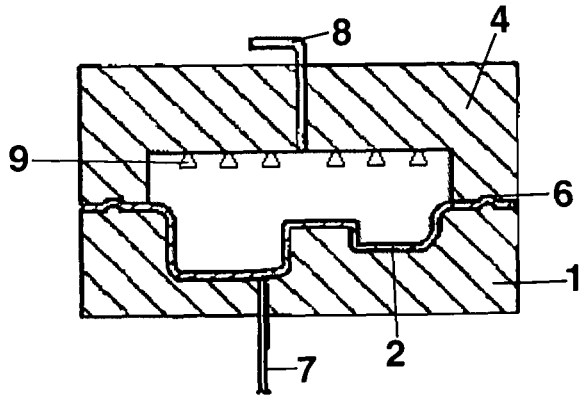

The present invention is more fully described in the light of the accompanying drawings showing a preferred embodiment. In the drawings, FIG. 1 shows a forming tool for titanium sheet in an open condition with the unformed workpiece inserted, FIG. 2 shows the forming tool according to FIG. 1 in a closed condition during the forming process, and FIG. 3 shows the forming tool with the finish-formed workpiece.

The titanium sheet 5 to be formed, here TiAl6V4 having a thickness of less than 1 mm, is located between a forming tool 1, which features a forming tool contour 3 corresponding to the desired shape of the finished workpiece 2, and a hollow tool body 4. A sealing element 6 is provided on the opposite seating surfaces of forming tool 1 and hollow body 4 which provides for safe sealing between titanium sheet 5 and forming tool 1 on the one hand, as well as between titanium sheet 5 and the hollow body 4 on the other hand. The forming tool 1 is provided with an evacuation port 7 connected to a vacuum pump (not shown), while the hollow body 4 is connected via an inlet port 8 to a pressure gas source (not shown). Heating elements 9, here Kanthal® heating resistors, are arranged on the inner surface of the tool hollow body 4 opposite of, and directed to, the titanium sheet (sheet blank) 5. When the titanium sheet 5 (FIG. 2) is sealingly held between the forming tool 1 and the tool hollow body 4, which are both in cold condition, vacuum, or at least underpressure, is produced in the forming tool cavity 10 between tool contour 3 and titanium sheet 5. The radiation heat of approx. 1600° C. generated by the heating elements 9 heats the titanium sheet 5 to a temperature of approx. 600° C. In the sealingly closed state of the forming apparatus, a gaseous forming medium heated to approx. 600° C., here argon, is introduced into the tool cavity 11 between titanium sheet 5 and tool hollow body 4 at a pressure of 40 bar by virtue of which the heated titanium sheet 5 is deformed towards the forming tool contour 3, due to the vacuum generated beforehand without any counterpressure and negative gas effect on the underside of the titanium sheet. Since the forming tool 1 is cold, the material immediately cools down as it contacts the forming tool contour 3 or a protruding section 12 thereof (FIG. 2), as a result of which the workpiece contour formed is immediately stabilised so that, as of this early point, no material damage in the form of embrittlement by gas absorption (hydrogen, oxygen) and oxidation will occur, this being anyway counteracted by the fact that the workpiece is heated to max. 600° C.

FIG. 1 shows the forming apparatus prior to closing the two tool halves—forming tool 1 and tool hollow body 4. In the illustration in FIG. 2 with sealingly closed tool halves, the gaseous forming pressure medium is fed into the tool cavity 11 and a vacuum is produced in the forming tool cavity 10. With the heating elements 9 activated, the titanium sheet 5 is deformed under the effect of the pressure medium already to such a degree that the cold finished contour of the workpiece is reached at a section 12 of the forming tool contour 3. In FIG. 3, the forming process is complete. Supply of pressure medium and production of underpressure as well as generation of heat by the heating elements are interrupted. Upon opening the forming apparatus, the finished workpiece 2, formed without spring-back or material damage, can be unloaded from the cold tool.

LIST OF REFERENCE NUMERALS

1 Forming tool
2 Workpiece
3 Forming tool contour
4 Hollow body tool
5 Titanium sheet
6 Sealing element
7 Evacuation port
8 Inlet port
9 Heating elements
10 Forming tool cavity (forming vacuum)
11 Forming tool cavity (forming pressure)
12 Protruding section of 3

What is claimed is:

1. A method for hot forming of sheet metal of titanium-base alloys in a forming apparatus, comprising:

holding a sheet of titanium-base alloy to be formed between two sealingly closed halves of a tool, thereby forming a pressure side of the tool and a vacuum side of the tool on opposite sides of the held sheet, heating the sheet from the pressure side to a hot-forming temperature with radiation heat from heating elements integrated into the tool, and deforming the sheet towards a vacuum side tool contour by action of a heated gaseous pressure medium free from oxidizing constituents injected into the pressure side and the further action of a vacuum generated on the vacuum side of the titanium-base alloy sheet facing away from the pressure medium;

maintaining the vacuum side tool contour cold relative to the heated sheet of titanium-base alloy during the deforming of the sheet such that the heated sheet of titanium-base alloy is immediately cooled and stabilized upon contact of the sheet with the cold vacuum side tool contour.

2. The method of claim 1, wherein the hot-forming temperature does not exceed 600° C.

3. The method of claim 2, wherein the pressure medium is heated to the respective hot-forming temperature.

4. The method of claim 3, wherein the pressure of the gaseous pressure medium is variable, depending on material, material thickness, workpiece contour and hot-forming temperature.

5. The method of claim 4, wherein inert gas is used as the pressure medium.

6. The method of claim 5, wherein the pressure medium is heated in a heat exchanger outside of the forming apparatus.

7. The method of claim 1, wherein the pressure medium is heated to the respective hot-forming temperature.

8. The method of claim 1, wherein the pressure of the gaseous pressure medium is variable, depending on material, material thickness, workpiece contour and hot-forming temperature.

9. The method of claim 1, wherein inert gas is used as the pressure medium.

10. The method of claim 1, wherein the pressure medium is heated in a heat exchanger outside of the forming apparatus.

11. The method of claim 1, and further comprising positioning the at least one heating element in a pressure cavity of the apparatus on an inner surface of the tool hollow body and directed toward the sheet of titanium-base alloy.

12. A forming apparatus for hot forming of sheet metal of titanium-base alloys, comprising:

a forming tool having a first portion having a forming tool contour and second portion having a hollow body, between which first portion and second portion a sheet of titanium-base alloy to be formed can be sealingly held, at least one heating element positioned in the hollow body directed towards the sheet for heating the sheet, an inlet port in the tool for supplying a gaseous pressure medium to one side of the sheet, and an evacuation port in the tool for generating a vacuum on an opposite side of the sheet;

wherein the second portion of the forming tool is not directly heated to maintain a cold forming tool contour relative to the heated sheet of titanium-base alloy for cooling and stabilizing the heated sheet of titanium-base alloy upon contact with the cold forming tool contour.

13. The apparatus of claim 12, wherein the at least one heating element is a Kanthal® heating resister positioned in the tool hollow body.

14. The apparatus of claim 12 and further comprising valve equipment to connect the inlet port to a pressure medium source via a heat exchanger and valve equipment to connect the evacuation port to a vacuum pump.

15. The apparatus of claim 12, wherein the at least one heating element is positioned in a pressure cavity of the apparatus on an inner surface of the tool hollow body and directed toward the sheet of titanium-base alloy.

16. A forming apparatus for hot forming of sheet metal of titanium-base alloys, comprising:

a forming tool having a forming tool contour and a hollow body between which a sheet of titanium-base alloy to be formed is sealingly held, at least one heating element positioned in the hollow body directed towards the sheet, an inlet port in the tool for supplying a gaseous pressure medium to one side of the sheet, an evacuation port in the tool for generating a vacuum on an opposite side of the sheet, a heat exchanger positioned outside of the forming apparatus for heating the pressure medium prior to entry into the forming tool.

17. The apparatus of claim 16 and further comprising valve equipment to connect the inlet port to the heat exchanger and valve equipment to connect the evacuation port to a vacuum pump.

18. A method for hot forming of sheet metal of titanium-base alloys in a forming apparatus, comprising:

holding a sheet of titanium-base alloy to be formed between two sealingly closed halves of a tool, heating the sheet to a hot-forming temperature with radiation heat from heating elements integrated into the tool, deforming the sheet towards a cold tool contour by action of a heated gaseous pressure medium free from oxidizing constituents and the further action of a vacuum generated on a side of the titanium-base alloy sheet facing away from the pressure medium;

heating the pressure medium in a heat exchanger outside of the forming apparatus.

19. The method of claim 18, wherein the pressure medium is heated to the respective hot-forming temperature.

* * * * *